United States Patent [19]

Paneccasio

[11] Patent Number: 4,512,856

[45] Date of Patent: Apr. 23, 1985

[54] ZINC PLATING SOLUTIONS AND METHOD UTILIZING ETHOXYLATED/PROPOXYLATED POLYHYDRIC ALCOHOLS

[75] Inventor: Vincent Paneccasio, Madison, Conn.

[73] Assignee: Enthone, Incorporated, New Haven, Conn.

[21] Appl. No.: 614,693

[22] Filed: May 25, 1984

Related U.S. Application Data

[63] Continuation of Ser. No. 253,657, Apr. 13, 1981, abandoned, which is a continuation of Ser. No. 95,483, Nov. 19, 1979, abandoned.

[51] Int. Cl.[3] ..... C25D 3/22

[52] U.S. Cl. ..... 204/55 R

[58] Field of Search ..... 204/55 R, 44.2, 114

[56] References Cited

U.S. PATENT DOCUMENTS

| | | | |
|---|---|---|---|
| 4,070,256 | 1/1978 | Hsu et al. | 204/55 R |
| 4,075,066 | 2/1978 | Eckles et al. | 204/55 R |
| 4,162,947 | 7/1979 | Canaris | 204/55 R |

FOREIGN PATENT DOCUMENTS

| | | | |
|---|---|---|---|
| 10536 | 4/1975 | Japan | 204/55 R |
| 10534 | 4/1975 | Japan | 204/55 R |
| 10535 | 4/1975 | Japan | 204/55 R |
| 602591 | 5/1948 | United Kingdom | 204/55 R |
| 895156 | 5/1962 | United Kingdom | 204/55 R |
| 1066820 | 4/1967 | United Kingdom | 204/55 R |
| 1378891 | 12/1974 | United Kingdom | 204/55 R |

*Primary Examiner*—G. L. Kaplan

*Attorney, Agent, or Firm*—DeLio & Associates

[57] ABSTRACT

Aqueous, acid zinc electroplating solutions and method for electroplating zinc coatings are provided. The plating solutions of the invention contain a source of zinc ions, an electrolyte, at least one organic acid or salt thereof, and a novel grain-refining agent comprising a substituted polyhydric alcohol having three or more ethoxylated and/or propoxylated hydroxyl groups. Bright and lustrous zinc coatings can be electroplated from such solutions at temperatures ranging from between about 50° to 100° F., with the plating solutions exhibiting no significant cloud point.

17 Claims, No Drawings

ZINC PLATING SOLUTIONS AND METHOD UTILIZING ETHOXYLATED/PROPOXYLATED POLYHYDRIC ALCOHOLS

This is a continuation of Ser. No. 253,657, filed Apr. 13, 1981 which in turn was a continuation of Ser. No. 095,483, filed Nov. 19, 1979 and both now abandoned.

DESCRIPTION OF INVENTION

1. Technical Field

This invention relates to the field of electroplating, or electrodepositing, zinc and, in preferred embodiments, to novel acid zinc plating solutions which are capable of providing a high quality bright and lustrous zinc deposit on a conductive workpiece utilizing conventional electroplating apparatus. The invention also provides an improved method for electroplating high quality zinc coatings from the novel acid zinc plating solutions of the invention. Either bright and lustrous, or semi-bright, zinc platings, having excellent adhesion and a high degree of ductility can be produced in accordance with the invention.

2. Background

It is well known in the art that bright and lustrous metallic zinc deposits can be electroplated on a metallic substrate from aqueous acid zinc plating solutions, or baths. However, difficulties persist in commercially producing uniform and reliable zinc coatings with sufficiently high levels of brightness and luster.

For example, the temperature of the plating solution must be controlled generally within a range of about 60° to 90° F. (15° to 30° C.). Particularly at higher temperatures, difficulties are experienced with "clouding", or instability of the plating solutions, particularly with solution components which are hydrophobic or contain hydrophobic substituents. At lower temperatures, difficulties are encountered in obtaining uniform and acceptable zinc coatings, particularly with regard to avoidance of streaking and like surface imperfections.

In conventional acid zinc plating baths, grain-refining agents are utilized to produce a commercially acceptable bright and lustrous zinc coating. Without grain-refining agents, the zinc coatings produced by conventional baths may not exhibit uniformly smooth and refined surfaces over the full range of current densities normally encountered in commercial applications. In the prior art, grain-refining agents have typically been polyethers which contain substantial quantities of hydrophobic substituents, exhibit substantial surface-active properties and are classified as surfactants.

Due to the presence of substantial quantities of hydrophobic substituents, the solubility of the prior art grain-refining agents in an aqueous, acid zinc plating bath has been of critical importance. Such baths typically exhibit a low "cloud point", which is the point at which the surfactant or hydrophobic materials begin to separate from the aqueous plating solution.

It is also desirable to utilize agitation in a zinc plating bath, which is typically provided by bubbling air through the plating solution. However, the presence of conventional grain-refining agents, which are surfactants, leads to excess foaming that must be controlled, usually by addition of further additives, such as defoaming agents or the like.

Illustrative of aqueous, acid zinc plating systems utilizing such prior art grain-refining agents are those disclosed in U.S. Pat. Nos. 3,920,528; 3,928,149; 4,014,761; 4,075,066; 4,119,502; 4,137,133; and 4,138,394. U.S. Pat. No. 3,891,520 discloses use of polymers of polyethylene glycol, which are dihydric alcohols, while U.S. Pat. No. 4,070,256 indicates that aliphatic monohydric alcohols can be utilized. However, both the monohydric and dihydric alcohols used in the prior art are surface-active agents (i.e., surfactants) and are foamers in the acid zinc plating baths in which they are utilized. U.S. Pat. No. 3,945,894 discloses use of water soluble polyglycidols and derivatives thereof, which exhibit poor throwing and covering power, and cause formation of unacceptable bands or interference in the mid-current density ranges.

In all of these acid zinc plating baths of the prior art, there remains a need for a grain-refining agent which makes little, if any, contribution to the cloud point of the bath, and which does not foam in the operating zinc plating solutions.

The improved zinc acid plating solutions and method of the invention provide both a wide latitude of operational utility, particularly with respect to the operable temperatures of the plating bath. They also do not contribute to foaming. They are particularly useful and advantageous because they allow for continuous operation at higher bath temperatures than is presently possible, without deterioration or clouding of the plating solutions. In addition, they allow for commercially acceptable plating to proceed at much lower temperatures than is presently possible. This eliminates the need for preliminary heat up of the plating baths before plating can be started.

SUMMARY OF INVENTION

In accordance with the invention, it has been discovered that aqueous, acid zinc plating solutions for electrodeposition of zinc coatings can be provided utilizing a grain-refining agent comprising a non-surfactant substituted polyhydric alcohol having three or more ethoxylated and/or propoxylated hydroxyl groups. Typically, the aqueous, acid zinc plating solutions of the invention contain a source of zinc ions, an electrolyte which provides electrolytically charged ions which are capable of conducting an electric current, at least one organic brightener or luster forming agent, and an organic acid or salt thereof, in addition to the novel grain-refining agents of the invention. Preferably, these plating solutions may also contain a buffering agent, as well as other optional additives which do not adversely effect the solubility or stability of the zinc plating solution. Semi-bright zinc coatings can likewise be produced by variation, elimination, of the amount of brightener used in these plating solutions.

The plating solutions of the invention can be effectively operated at a temperature ranging from about 50° to 100° F. (10° to 49° C.) and at a pH ranging from between about 4.5 to 6.5. These plating solutions effectively have no significant cloud point and substantially no foam is generated by the grain-refining agents of the invention in the plating solution, even when air agitation is utilized.

An improved method for electroplating zinc coatings, preferably having a bright and lustrous appearance, is also provided in accordance with the invention, whereby the novel aqueous, acid zinc plating solution of the invention is utilized for electroplating.

Zinc coatings can be produced in accordance with the invention which exhibit excellent grain refinement and high quality brightness and luster over a wide range of current densities and plating conditions. If less brightener is used, a semi-bright zinc plate having excellent adhesion and a high degree of ductility can be produced.

Accordingly, it is an object of the invention to provide improved aqueous, acid zinc plating solutions which contain grain-refining agents and permit electrodeposition of commercially acceptable bright and lustrous, or semi-bright, zinc coatings over a wider range of plating conditions, most notably temperature, than is possible with conventional acid zinc plating baths.

It is a further object of the invention to provide an improved aqueous, acid zinc plating solution which does not foam when air agitation or the like is utilized during electroplating of bright and lustrous zinc coatings.

It is yet a further object of the invention to provide an improved method of electroplating zinc coatings over the widest possible range of plating conditions, particularly temperature, and without foaming.

Other objects and advantages of the novel aqueous, acid zinc plating solution and method of the invention will be readily apparent to those skilled in the art through study of the following description of the preferred embodiments and the appended claims.

DESCRIPTION OF PREFERRED EMBODIMENTS AND BEST MODE FOR CARRYING OUT THE INVENTION

Description of Preferred Embodiments

An improved aqueous, acid zinc plating solution capable of electroplating bright and lustrous zinc coatings is provided in accordance with a preferred embodiment of the invention. Such an aqueous acid zinc plating bath contains a source of zinc ions in solution. Any conventional source of zinc ions can be utilized. For example, zinc chloride, zinc sulfate, zinc sulfamate, zinc acetate, zinc fluoborate or mixtures thereof can be dissolved in aqueous solution. Nevertheless, it is fully within the purview of the invention that any compound or material capable of providing a source of zinc ions in aqueous solution, which does not otherwise interfere with the stability or operability of the resultant aqueous zinc plating solution, can be utilized.

An electrolyte is provided in the aqueous plating solution to provide electrically charged ions capable of conducting an electrical current. For example, an electrolyte may be selected from any soluble alkali salt of hydrochloric acid, sulfuric acid, sulfamate acid, fluoboric acid, or acetic acid, or from ammonium chloride, ammonium sulfate, ammonium sulfamate, ammonium acetate, ammonium fluoborate or mixtures thereof. It is fully within the purview of the invention that other suitable electrolytes may be utilized, provided they do not interfere either with the stability of operability of the resultant aqueous zinc plating bath.

Since the preferred embodiment of the novel zinc plating solution of the invention is to be operable to provide a bright or lustrous zinc coating, at least one brightening agent is added to the bath. The amount of such brightening agent may be varied to control the degree of brightness required. For example, conventional brightening agents such as benzylidene acetone or o-chlorobenzaldehyde may be utilized. Of course, if a semi-bright or dull zinc coating is desired, a reduced amount of brightener may be utilized or the brightening agent omitted from the plating bath all together. Such modification of the specific composition of the novel zinc plating solution of the invention is fully within the skill of one in the art.

The zinc plating bath of the invention also contains an organic acid, or salt of an organic acid. Preferably, benzoic acid or sodium benzoate are utilized.

The aqueous zinc plating solution of the invention further contains a novel and improved grain-refining agent comprising a polyhydride alcohol having three or more hydroxyl groups substituted with one or more oxyalkylene groups. Preferably, a polyhydric alcohol such as glycerin, sorbitol, mannitol or the like is utilized, having hydroxyl groups substituted with either oxyethylene or oxypropylene groups, or combinations thereof.

It is within the purview of the invention that the number of oxyalkylene groups substituted on a polyhydric alcohol which can be used as improved grain-refining agent of the invention may be varied over a broad range. The number depends upon the particular polyhydric alcohol which is substituted, the specific oxyalkylene group selected and variables of the zinc plating solution, such as pH, operating temperature and solubility. Accordingly, the number of oxyalkylene groups is not a limiting factor of the invention, provided the substituted polyhydric alcohol is soluble, and remains substantially soluble, in the zinc plating solutions of the invention.

Preferably, when the grain-refining agent of the invention is glycerin substituted with oxyethylene groups, between 5 to 30 moles of ethylene oxide are substituted for hydroxyl groups. Glycerin substituted with oxypropylene groups preferably has between 3 and 15 moles of propylene oxide substituted for hydroxyl groups.

When the grain-refining agent of the invention is an oxyethylene substituted sorbitol, preferably between 6 and 100 moles of ethylene oxide are substituted for hydroxyl groups. Sorbitol substituted with oxypropylene groups preferably has between 1 and 20 moles of propylene oxide substituted for hydroxyl groups.

It is fully within the purview of the invention that such polyhydric alcohols may have less than all available hydroxyl sites substituted. However, it is preferred that all available hydroxyl groups should be substituted with an oxyalkylene group.

Furthermore, while oxyalkylene groups normally terminate with a hydroxyl group, the terminal hydrogen may be substituted with any radical group which does not interfere with, or adversely effect, the solubility or performance of the grain-refining agent in the zinc plating solution.

It is also fully within the purview of the invention that the substituted polyhydric alcohols utilized as grain-refining agents in accordance with the invention may contain one or more different oxyalkylene groups. For example, glycerin having some hydroxyl sites substituted with oxyethylene and other hydroxyl sites substituted with oxypropylene can be utilized in accordance with the invention. Furthermore, grain-refining agents in accordance with the present invention may contain blends of various different polyhydric alcohols substituted with various different oxyalkylene groups.

Preferably, an anionic surfactant is also included in a zinc plating solution of the invention. For example, alkyl sulfates or sulfonates or alkyl aryl sulfonates can be advantageously utilized. Most preferred is the sodium salt of 2-ethyl hexyl sulfate.

Optionally, it may also be desirable to incorporate a buffering agent, such as boric acid or salts thereof, in the novel zinc plating solution of the invention. Other conventional types of additives and agents, which are not incompatible with the solubility or performance of the zinc plating solutions of the invention, may be also incorporated, if desired. For example, it is fully within the purview of the invention that hydrotropes or like additives can be optionally included in zinc plating solutions of the invention.

In accordance with the preferred embodiment of the method of the invention, an aqueous, acid zinc plating solution of the invention is used to electroplate a bright and lustrous zinc coating. The temperature of the zinc plating solution is maintained between about 50° F. to 120° F. (10° C. to 49° C.), and preferably between 65° and 90° F. (18°-33° C.), with a pH ranging from between about 4.5 to 6.5 and preferably between 4.9 and 5.3. Current density ranging from about 1 to 120 amps per square foot (amps/ft.$^2$) can be applied between a zinc anode and an immersed metallic workpiece.

In accordance with the method of the invention utilizing the improved aqueous, acid zinc plating solution, platings of zinc which are bright and lustrous over the entire range of current density are obtained. If semi-bright or dull zinc coatings are desired, and less brightening agent incorporated in the zinc plating solution, a semi-bright or dull zinc coating will be produced having excellent adhesion and a high degree of ductility.

While the thickness of the zinc coatings obtained in accordance with the invention is not limited, it usually ranges from between 0.1 and 0.6 mils (0.0001 to 0.0006 inches) and, preferably, about 0.25 mils (0.00025 inches).

In order to illustrate more fully the improved aqueous, acid zinc plating solutions and method of the invention, the following Examples are set forth, but are not intended to limit the scope of the invention.

EXAMPLE 1

An aqueous, acid zinc chloride plating solution was prepared by admixture of the following:

Zinc chloride: 34 g/l
Potassium chloride: 210 g/l
Boric acid: 26 g/l
2-ethyl hexyl sulfate sodium salt: 21 g/l
Benzoic acid, sodium salt: 3.7 g/l
Benzylidene acetone: 0.26 g/l
o-chlorobenzaldehyde: 0.07 g/l
Glycerin ethoxylated with 17 moles of ethylene oxide: 8.5 g/l This zinc plating solution had a pH between 4.9 and 5.3 and a temperature of 75° F. (23.9° C.). A steel panel was prepared in the conventional manner and placed in a standard Hull cell. Two amps of electrical current was applied across the electrodes of the cell for 5 minutes, so as to produce a current density ranging from about 1 to 120 amps/ft.$^2$. Solution agitation was provided by mechanical motion.

After 5 minutes, the flow of current was terminated and panel removed for examination. The panel was coated with a bright and lustrous plating of zinc over the entire range of current densities.

EXAMPLE 2

Example 1 was repeated, with the exception that glycerin ethyoxylated with 26 moles of ethylene oxide (commercially available under the trade name MACOL ETG-26) was used as the grain-refining agent.

The resultant panel exhibited a bright and lustrous plating of zinc over the entire range of current densities.

EXAMPLE 3

Example 1 was repeated, except that glycerin ethoxylated with 5 moles of ethylene oxide was used as the grain-refining agent.

The resultant panel exhibited a bright and lustrous plating over the entire range of current density.

EXAMPLE 4

Example 1 was repeated, except that glycerin ethoxylated with 30 moles of ethylene oxide was used as the grain-refining agent.

The resultant panel exhibited a zinc plating which was bright and lustrous over the entire range of current density.

EXAMPLE 5

Example 1 was repeated, except that plating was conducted at an elevated temperature which ranged between 120° and 125° F. (48.9° to 51.7° C.).

The resultant zinc coating on the panel exhibited a bright and lustrous appearance over the entire range of current density.

EXAMPLE 6

For purposes of comparison with the performance of a grain-refining agent of the prior art, Example 5 was repeated, except that a conventional grain-refining agent comprising cetyl-stearyl alcohol ethoxylated with 26 moles of ethylene oxide was used in place of the substituted glycerin material of the invention.

The zinc plating solution clouded and the grain-refining agent partially separated from solution forming an oily film. The resultant zinc plating on the panel exhibited poor grain refinement and an oily surface, and was commercially unacceptable.

EXAMPLE 7

Example 1 was repeated, except that glycerin having hydroxyl groups substituted with 30 moles of ethylene oxide and 1.5 moles of propylene oxide was utilized as the grain-refining agent of the invention.

The resultant zinc coating on the panel was bright and lustrous over the entire range of current density.

EXAMPLE 8

Example 1 was repeated, except that glycerin having hydroxyl groups substituted with 12 moles of propylene oxide (commercially available under the trade name Macol ETG-12) was used as the grain-refining agent.

The resultant zinc coating on the panel was bright and lustrous over the entire range of current densities.

EXAMPLE 9

Example 1 was again repeated, except that sorbitol ethoxylated with 50 moles of ethylene oxide was utilized as the grain-refining agent.

The resultant zinc coating on the panel was bright and lustrous over the entire range of current density.

Although the preceding specific examples are presented solely for purposes of illustration, it is to be understood that such zinc plating solutions and methods of electroplating zinc utilizing the same in accordance with the invention maybe altered, varied or modified without departing from the spirit or scope of the invention as defined by the appended claims.

What is claimed is:

1. An aqueous, acid zinc plating solution for electrodeposition of zinc coatings consisting essentially of:
(a) a source of zinc ions;
(b) an electrolyte which provides electrolytically charged ions capable of conducting an electric current;
(c) an organic acid or salt of an organic acid; and
(d) a grain refining agent comprising a polyhydric alcohol selected from the group consisting of glycerin having 5 to 30 moles of ethylene oxide substituted for hydroxyl groups, glycerin having 3 to 15 moles of propylene oxide substituted for hydroxyl groups, sorbitol having 6 to 100 moles of ethylene oxide substituted for hydroxyl groups, or sorbitol having 1 to 20 moles of propylene oxide substituted for hydroxyl groups.

2. The aqueous, acid zinc plating solution of claim 1 further including at least one organic brightening agent.

3. The aqueous, acid zinc plating solution of claim 1 where said source of zinc ions is a zinc salt selected from zinc chloride, zinc sulfate, zinc sulfamate, zinc acetate, zinc fluoborate or mixtures thereof and said electrolyte is selected from a soluble alkali salt of hydrochloric acid, sulfuric acid, sulfamic acid, fluoboric acid, or acetic acid, and ammonium chloride, ammonium sulfate, ammonium sulfamate, ammonium acetate, ammonium fluoborate or mixtures thereof.

4. The aqueous, acid zinc plating solution of claim 1 further including an anionic surfactant.

5. The aqueous, acid zinc plating solution of claim 1 further including one or more additives selected from buffering agents, selected from boric acid or salts thereof, or hydrotropes.

6. The aqueous, acid zinc plating solution of claim 1 wherein said polyhydric alcohol has at least one mole of oxyalkylene substituted per available hydroxyl group, said oxyalkylene being selected from oxyethylene or oxypropylene.

7. The aqueous, acid zinc plating solution of claim 6 wherein said polyhydric alcohol is selected from glycerin having 17 moles of ethylene oxide substituted for hydroxyl groups, glycering having 26 moles of ethylene oxide substituted for hydroxyl groups, glycerin having 12 moles of propylene oxide substituted for hydroxyl groups, glycerin having 30 moles of ethylene oxide and 1.5 moles of propylene substituted for hydroxyl groups, or sorbitol having 50 moles of ethylene oxide substituted for hydroxyl groups.

8. An improved method for electroplating bright and lustrous zinc comprising:
(a) providing an aqueous, acid zinc plating solution consisting essentially of zinc ions, an electrolyte, an organic acid or salt thereof, and a grain-refining agent comprising a polyhydric alcohol selected from the group consisting of glycerin having 5 to 30 moles of ethylene oxide substituted for hydroxyl groups, glycerin having 3 to 15 moles of propylene oxide substituted for hydroxyl groups, sorbitol having 5 to 100 moles of ethylene oxide substituted for hydroxyl groups, or sorbitol having 1 to 20 moles of propylene oxide substituted for hydroxyl groups,
(b) maintaining said plating solution at a temperature ranging between about 50° F. to 120° F. and pH of between about 4.5 to 6.5,
(c) immersing a metallic workpiece and a zinc anode in said plating solution, and
(d) applying a voltage across said metallic workpiece and said anode to cause electroplating of zinc to occur on said metallic workpiece.

9. The method of claim 8 further including in said plating solution at least one brightening agent.

10. The method of claim 8 wherein said source of zinc ions is a zinc salt selected from zinc chloride, zinc sulfate, zinc sulfamate, zinc acetate, zinc fluorborate or mixtures thereof and said electrolyte is selected from a soluble alkali salt of hydrochloric acid, sulfuric acid, sulfamic acid, fluoboric acid, or acetic acid, and ammonium chloride, ammonium sulfate, ammonium sulfamate, ammonium acetate, ammonium fluoborate or mixtures thereof.

11. The method of claim 8 further including in said plating solution an anionic surfactant.

12. The method of claim 8 wherein said zinc plating solution further includes one or more additives selected from buffering agents, selected from boric acid or salts thereof, or hydrotropes.

13. The method of claim 8 wherein said polyhydric alcohol has at least one mole of oxyalkalene substituted per available hydroxyl group, said oxyalkylene being selected from oxyethylene or oxypropylene.

14. The method of claim 8 wherein said polyhydric alcohol is selected from glycerin having 17 moles of ethylene oxide substituted for hydroxyl groups, glycerin having 26 moles of ethylene oxide substituted for hydroxyl groups, glycerin having 12 moles of propylene glycol substituted for hydroxyl groups, glycerin having 30 moles of ethylene oxide and 1.5 moles of propylene oxide substituted for hydroxyl groups or sorbitol having 50 moles of ethylene oxide substituted for hydroxyl groups.

15. An aqueous, acid zinc plating solution for electrodeposition of zinc coatings consisting essentially of:
(a) a source of zinc ions;
(b) an electrolyte which provides electrolytically charged ions capable of conducting an electric current;
(c) an organic acid or salt of an organic acid;
(d) a grain refining agent comprising a polyhydric alcohol selected from the group consisting of glycerin having 5 to 30 moles of ethylene oxide substituted for hydroxyl groups, glycerin having 3 to 15 moles of propylene oxide substituted for hydroxyl groups, sorbitol having 6 to 100 moles of ethylene oxide substituted for hydroxyl groups, or sorbitol having 1 to 20 moles of propylene oxide substituted for hydroxyl groups, and
(e) at least one brightening agent selected from benzylidene acetone or o-chlorobenzaldehyde.

16. An improved method for electroplating bright and lustrous zinc comprising:
(a) providing an aqueous, acid zinc plating solution consisting essentially of zinc ions, an electrolyte, an organic acid or salt thereof, a brightening agent selected from benzylidene acetone or o-chlorobenzaldehyde, and a grain-refining agent comprising a polyhydric alcohol selected from the group consisting of glycerin having 5 to 30 moles of ethylene oxide substituted for hydroxyl groups, glycerin having 3 to 15 moles of propylene oxide substituted for hydroxyl groups, sorbitol having 5 to 100 moles of ethylene oxide substituted for hydroxyl groups, or sorbitol having 1 to 20 moles of propylene oxide substituted for hydroxyl groups;

(b) maintaining said plating solution at a temperature ranging between about 50° F. to 120° F. and pH of between about 4.5 to 6.5;

(c) immersing a metallic workpiece and a zinc anode in said plating solution, and (d) applying a voltage across said metallic workpiece and said anode to cause electroplating of zinc to occur on said metallic workpiece.

17. An aqueous, acid zinc electroplating solution comprising:

(a) zinc chloride;

(b) potassium chloride;

(c) boric acid;

(d) 2-ethyl hexyl sulfate, sodium salt;

(e) benzoic acid, sodium salt;

(f) benzylidene acetone;

(g) o-chlorobenzaldehyde; and (h) glycerin ethoxylated with 17 moles of ethylene oxide.

* * * * *